United States Patent [19]

Niskin

[11] 3,986,635

[45] Oct. 19, 1976

[54] CLOSURE LOCKING AND ORIENTING DEVICE

[76] Inventor: Shale J. Niskin, 2941 Lucaya St., Miami, Fla. 33133

[22] Filed: Apr. 3, 1975

[21] Appl. No.: 564,600

[52] U.S. Cl. ..... 220/319; 220/326; 292/256.6

[51] Int. Cl.[2] ..... B65D 45/32

[58] Field of Search ..... 220/319, 324, 320, 326; 292/256.6, 256.63

[56] References Cited

UNITED STATES PATENTS

| | | | |
|---|---|---|---|
| 2,436,407 | 2/1948 | Stephens | 220/319 |
| 2,662,788 | 12/1953 | Carpenter | 292/256.6 |

FOREIGN PATENTS OR APPLICATIONS

| | | | |
|---|---|---|---|
| 594,265 | 9/1925 | France | 292/256.63 |
| 814,423 | 6/1959 | United Kingdom | 220/319 |

*Primary Examiner*—William Price
*Assistant Examiner*—Joseph M. Moy
*Attorney, Agent, or Firm*—Salvatore G. Militana

[57] ABSTRACT

A closure locking and orienting device for securing the closure to a housing at an opening therein having a semi-circular groove on the periphery of the closure and a similar groove at the opening of the housing, the grooves being in opposing relation to form a circular groove about the closure. A bore extends radially through the housing and the closure, a further bore extending through the housing communicating with the circular groove and an elongated and substantially pliable member threaded through the further bore, received by the circular groove and extending about the closure to span the juncture between the closure and the housing with the other end of the pliable member extending through the radially disposed bore to lock the closure to the housing while orienting the closure with relation to the housing.

5 Claims, 6 Drawing Figures

CLOSURE LOCKING AND ORIENTING DEVICE

BACKGROUND OF THE INVENTION

1. Field of the Invention

This invention relates to lid or closure locking devices and is more particularly directed to such a device which also orients the closure with relation to the housing.

2. Description of the Prior Art

The present closures or lids are locked in an opening of a housing by means of a split ring which spans the juncture of the closure and the housing by bearing against the outer surface of the closure and being received in an open groove formed in the housing. The closure is wedged in the opening by a shoulder formed in the housing on one side of the closure and the split ring bearing against the other side of the closure. In order to lock the closure in place, the closure is first inserted into the opening in the housing and made to abut against the shoulder. Then the resilient split ring is contracted so that it will fit into the opening above the closure and placed in coplanar relation with the open groove in the housing. Upon releasing the contracted split ring, the latter will expand to its normal size to be received by the open groove whereby the split ring now spans the juncture between the closure and the housing. The objections to the use of the split ring for securing a closure member to a housing are manifold. One objection is the difficulty to contract the split ring when removing it from the housing to release the closure member. Another objection is the possibility of the split ring losing its resiliency and failing to expand when placed in position to lock the closure member in place on the housing. Also, if the juncture of the closure member and the housing is not accessible as occurs when the closure member is fastened to a support member or if a single closure member is used to close off a pair of housings mounted end to end then a split ring cannot be used. The present invention contemplates avoiding all of the above objections to the use of a closure member or lid for closing off an opening in a housing, as well as being able to orient the lid with relation to the housing when such is desired.

BRIEF SUMMARY OF THE INVENTION

Therefore, a principal object of the present invention is to provide a closure locking and orienting device for a housing which spans the juncture between the closure member and the housing by the use of an elongated pliable member.

Another object of the present invention is to provide a locking member for securing a closure member to a housing by utilizing an elongated and pliable member spanning the juncture therebetween.

A further object of the present invention is to provide an elongated and pliable member for locking a closure member to a housing and a pair of aligned and transversely positioned bores for receiving an end portion of the elongated member for orienting the closure member with relation to the housing.

A further object of the present invention is to provide an elongated and pliable member for locking a closure member to a housing by forming arcuate mating grooves on the closure member and the housing for receiving the pliable member which spans the juncture therebetween and a bore formed in the housing communicating with the mating grooves for readily sliding the pliable member into the mating grooves.

With these and other objects in view, the invention will be best understood from a consideration of the following detailed description taken in connection with the accompanying drawing forming a part of this specification, with the understanding, however, that the invention is not confined to any strict conformity with the showing of the drawing but may be changed or modified so long as such changes or modifications mark no material departure from the salient features of the invention as expressed in the appended claims.

BRIEF DESCRIPTION OF THE SEVERAL VIEWS

DETAILED DESCRIPTION OF THE PREFERRED EMBODIMENT

Figure 1:
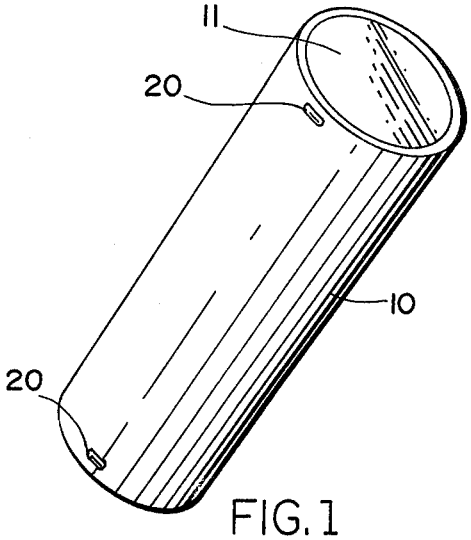
FIG. 1 is a perspective view of a housing having a closure member at each end secured thereto in accordance with my invention.

Referring to the drawing wherein like numerals are used to designate similar parts throughout the several views, the number 10 refers to a hollow housing having a closure or lid 11 enclosing the ends of the housing 10. The ends of the housing are provided with a peripheral shoulder 12 along the inner surface thereof adjacent the end portions against which the closure members 11 abut. The function of the peripheral shoulder 12 is to position the closure members 11 with relation to the housing 10 as is explained in detail hereinafter. Formed on the outer surface of the side wall 13 of each of the closure members 11 is a pair of peripheral grooves 14 and 15, the grooves 14 having a semicircular cross sectional shape while that of the grooves 15 is rectangular. In horizontal alignment with the groove 14 there is a peripheral groove 16 positioned in the inner wall surface of the housing 10, the groove 16 being of the same size and shape as the groove 14 with which it is in alignment. As stated hereinabove, when each of the closure members 11 is properly positioned to enclose the ends of the housing 10, the closure member 11 will rest on the shoulder 12 and the grooves 14 and 16 will be in alignment and combine with each other to form a circular cross sectional shape whose diameter is equal to that of an elongated locking member 20.

A pair of aligned bores 22 and 23 are formed radially thereof and extending into the housing 10 and the closure member 11. The housing 10 is provided with a still another bore 24 that extends approximately tangentially to the closure member 11 at the position of the grooves 14 and 16. Since the bores 22, 23 may be in the same or different horizontal plane than that of the grooves 14, 16, the bore 24 may extend horizontally or at an angle to the horizontal. In this instance the bores 22 and 23 and the grooves 14, 16 are in the same horizontal plane as shown by the FIG. 2.

When it is desired to position the closure member 11 over the open ends of the housing 10, the O-ring 21 is first snapped into place in the groove 15 of the closure member 11. The closure member 11 is then placed over the open end of the housing 10 with the bores 22 and 23 in vertical alignment, and the closure member 11 is then forced downwardly until the closure member 11 comes to rest on the shoulder 12. The O-ring 21 becomes compressed as the closure member 11 is sliding downwardly in the housing 10 until the closure member 11 abuts against the shoulder 12 and the juncture between the closure member 11 and housing 10 now becomes sealed against any moisture, water, etc. passing therethrough. At the same time, the grooves 14 and 16 become aligned as well as the bores 22 and 23.

Figure 2:
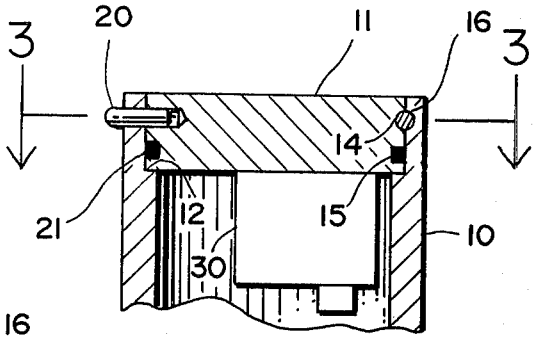
FIG. 2 is a fragmentary cross sectional view taken along the line 2—2 of FIG. 3.
Figure 3:
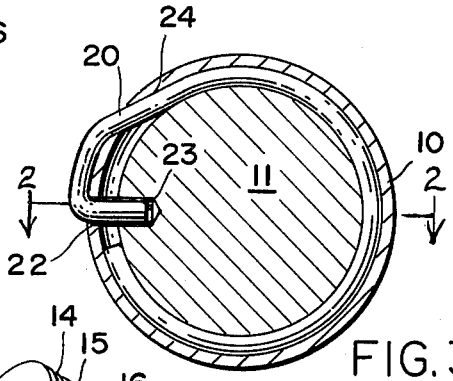
FIG. 3 is a cross sectional view taken along the line 3—3 of FIG. 2.
Figure 4:
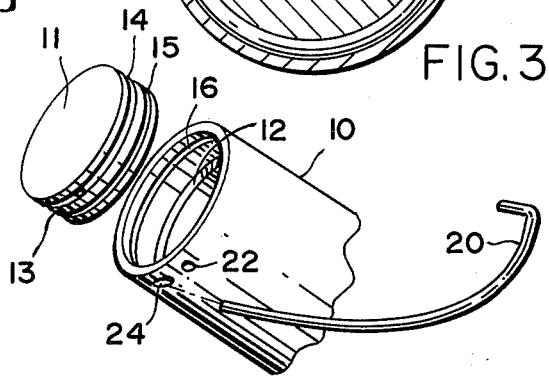
FIG. 4 is a fragmentary exploded view.

A pliable, elongated member 20 whose diameter is approximately equal to that of the combined grooves 14 and 16 is then threaded through the bore 24 to be received by the combined grooves 14 and 16. A pliable member 20 having a high tensile and shear strength is nylon monofilament which is ideal for use as the locking member. The nylon monofilament 20 which is forced into the grooves 14, 16 until the housing 10 has been encircled has its free end inserted into the bores 22 and 23. The closure member 11 is now locked into position on the housing 10 and oriented exactly with relation to the housing 10. The orientation of the closure member 11 must be as exact as shown by FIG. 2 wherein the housing 10 contains a camera 30 that is secured to the inner surface of the closure member 11. The camera 30 is focused on an instrument (not shown) as in a water flow current meter. Obviously, if the closure member 11 were mounted on the housing 10 in a relative position different from that shown by FIG. 3, the camera 30 would not be focused on the instrument whose recordings are to be photographed by the camera, since the camera lense is not positioned on the axis of the housing 10.

Figure 5:
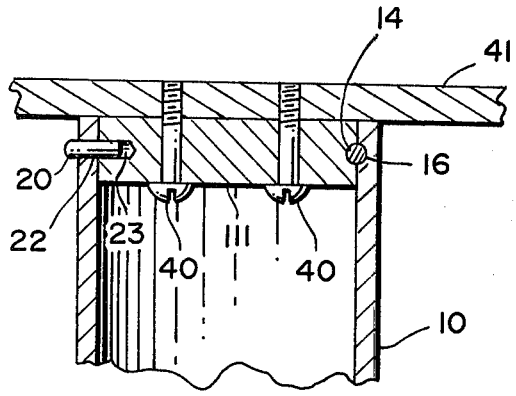
FIG. 5 is a fragmentary cross sectional view of a housing having a closure member secured to a support member.
Figure 6:
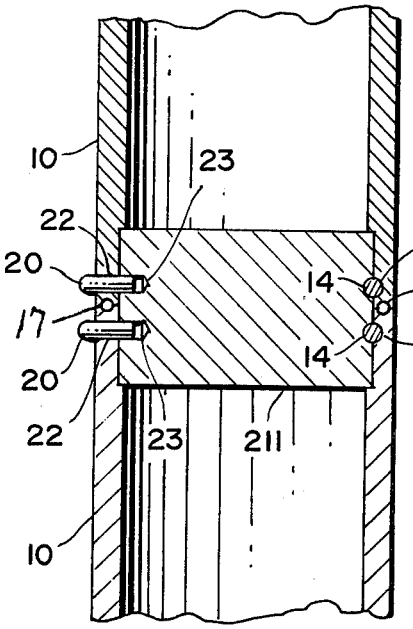
FIG. 6 is a similar view showing a pair of housings mounted end to end and secured together by a single closure member.

Alternate applications of my closure locking and orienting device are shown by FIGS. 5 and 6 and are particularly adaptable thereon. In FIG. 5, there is shown the housing 10 whose closure member 111 is fastened by bolts 40 to a support member 41. The locking structure of the pliable locking member 20 received in grooves 14, 16 and bores 22, 23 is identical to that shown and described hereinabove in connection with FIGS. 1-4 inclusive. It is intended that the closure member 111 remain fastened to the support 41 while the housing 10 may be removed and fastened to the closure member 111 as desired in the manner described hereinabove.

In FIG. 6, my locking structure is utilized to secure a pair of housings 10 together in end to end abutting relation. In this instance, a double closure member 211 is provided which has a pair of semi-circular grooves 14, each of which is in alignment with a similar groove 16 formed in the inner surface of each of the end portions of the abutting housings 10. The closure member 211 is also provided with a pair of radial bores 23 in alignment with bores 22 formed on housings 10 to each receive the nylon monofilament 20 in the same manner as previously described to lock the double closure member 211 to the two housings 10. The O-ring seal 15 is positioned in mating grooves 17 formed at the abutting ends of the housing 10 in the conventional manner to seal the housings 10 against leakage of moisture therethrough.

What I claim as new and desire to secure by Letters Patent is:

1. In a housing having an opening, a closure member mounted in said opening, said closure having a peripheral groove extending thereabout, said groove having a substantially arcuate cross sectional shape, said housing having a substantially similar groove in opposing relation to said peripheral groove to form a passageway spanning the juncture of said housing and said closure member, a bore extending through said housing and communicating with said passageway, an elongated and pliable member threaded through said bore and received in said passageway formed by said grooves to span the juncture between said closure member and said housing whereby said closure member is locked to said housing, and cooperatively engaging means mounted on said housing and said closure member for properly orienting said closure member with relation to said housing, said engaging means comprising a second bore extending through said housing and said closure member substantially transversely to said grooves and the free end of said elongated member received by said transversely extending second bore whereby said closure member becomes properly oriented with relation to said housing.

2. The structure as recited by claim 1 taken in combination with a second member mounted on said closure member and extending over said housing thereby covering the juncture of said closure member and said housing.

3. The structure as recited by claim 2 wherein said second member comprises a second housing having an opening in abutting relation with the first named housing at said opening, said closure member extending into said opening of said second member, said closure member having a second peripheral groove of substantially arcuate cross sectional shape, said second housing having a similar groove in opposing relation to said second peripheral groove forming a second passageway, a third bore in said second housing communicating with said second passageway and a second elongated pliable member extending through said third bore and received by said second passageway to secure said first named and second housings together.

4. The structure as recited by claim 3 taken in combination with a fourth bore extending through said second housing and said closure member substantially transversally to said second groove and the free end of said second pliable member being received by said third bore for orienting said housing.

5. The structure as recited by claim 1 wherein said arcuate cross sectional groove being semi-circular and said pliable member being cylindrical and having substantially the same diameter as said combined grooves.

* * * * *